US009278263B2

(12) United States Patent
Deshmukh et al.

(10) Patent No.: US 9,278,263 B2
(45) Date of Patent: Mar. 8, 2016

(54) MULTI-ZONE GOLF CLUB HEADS

(75) Inventors: Uday Deshmukh, Carlsbad, CA (US); Charles E. Golden, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 222 days.

(21) Appl. No.: 13/615,774

(22) Filed: Sep. 14, 2012

(65) Prior Publication Data

US 2014/0080631 A1 Mar. 20, 2014

(51) Int. Cl.
*A63B 53/04* (2015.01)

(52) U.S. Cl.
CPC ..... *A63B 53/04* (2013.01); *A63B 53/0466* (2013.01); *A63B 2053/0408* (2013.01); *A63B 2053/0412* (2013.01); *A63B 2053/0425* (2013.01); *A63B 2053/0429* (2013.01); *A63B 2053/0433* (2013.01); *A63B 2053/0437* (2013.01); *A63B 2209/00* (2013.01)

(58) Field of Classification Search
CPC ..... A63B 53/0466; A63B 53/04; A63B 2053/0425; A63B 2053/0429; A63B 2209/00; A63B 2053/0408; A63B 2053/0412; A63B 2053/0437; A63B 2053/0433
See application file for complete search history.

(56) References Cited

U.S. PATENT DOCUMENTS

| | | | | |
|---|---|---|---|---|
| 5,658,207 | A * | 8/1997 | Aizawa et al. | 473/345 |
| 6,341,723 | B1 * | 1/2002 | Nakahara et al. | 228/215 |
| 7,267,620 | B2 * | 9/2007 | Chao et al. | 473/342 |
| 7,699,719 | B2 * | 4/2010 | Sugimoto | 473/345 |
| 7,837,577 | B2 * | 11/2010 | Evans | 473/345 |
| 2002/0055396 | A1 * | 5/2002 | Nishimoto et al. | 473/345 |
| 2003/0034142 | A1 * | 2/2003 | Bliss et al. | 164/76.1 |

* cited by examiner

*Primary Examiner* — Stephen Blau
(74) *Attorney, Agent, or Firm* — Smith, Gambrell & Russell, LLP

(57) ABSTRACT

A golf club head with low and high density zones designed to provide specific densities for use in various parts of the club head to achieve maximum volume and properties within specific weight goals. The low and high density zones may be formed from laminates having different equivalent densities than the layers used to form the laminates.

18 Claims, 3 Drawing Sheets

MULTI-ZONE GOLF CLUB HEADS

FIELD OF THE INVENTION

The present invention relates to a golf club head comprising zones designed to provide specific densities for use in various parts of the club head to achieve maximum volume and properties within specific weight goals. More specifically, the present invention relates to a golf club head with properties that may be manipulated based on zones in the club head that are formed from laminates having different overall densities.

BACKGROUND OF THE INVENTION

Golf club designers are constantly manipulating the shape, size, and materials used to manufacture clubs in an effort to maximize performance. For example, fairway woods and hybrids typically have a similar overall mass as a driver, but less than half the volume of a driver. In particular, modern drivers are approximately 460 cc, whereas modern fairway woods range from approximately about 150 to 180 cc. Therefore, manufacturers typically use stainless steel materials for fairway woods and hybrids since the high density of steel provides a desirable mass distribution for the smaller head size. However, the smaller size of the face in fairway woods and hybrids makes it difficult to achieve maximum coefficient of restitution when using stainless steel because the elastic modulus is relatively high, and the face must remain a certain thickness in order not to compromise the durability.

While other lower density materials such as titanium or aluminum-based materials may be used to make the fairway wood, which increases the COR of the club head because of the lower modulus of the material, the low density of the material necessitates additional mass that must be added to meet the target head weight. Indeed, to achieve desirable mass properties in fairway woods, much of the discretionary mass is driven both toward the perimeter and low on the sole with the use of weights hidden within the club head. When made from titanium, the weights must be large and incorporated on the sole to keep the center of gravity (COG) as low as possible. However, the moment of inertia (MOI) (the resistance to twisting of any golf club head when the golf ball is impacted off center) may suffer with such a design and the large concentrated mass in the center of the sole may lead to acoustic issues. While other materials may be used for the weights, the bonding of non-titanium weights to a titanium-based club head is difficult to achieve with dissimilar metals. Alternatively, manufacturers have attempted to use higher density materials such as steel to form the sole of the otherwise titanium-based club head. However, creating a robust metallurgical bond around the perimeter of the steel plate is highly problematic.

Other types of clubs have similar issues. In fact, as drivers have increased in volume, their MOIs have also increased providing "larger sweet spots" and more forgiveness on off-center hits. However, when the volume is maximized through spatially distributing the mass in all three orthogonal orientations, the COG is positioned substantially rearward from the front face of the golf club head and high, which renders shots struck off-center from the sweet spot of the golf club head undesirable as a result of the increase in backspin. And, when weight members are attached to manipulate the COG, the club may become heavy and unwieldy, possibly to the point of limiting a golfer's swing speed and adversely affecting the golfer's swing mechanics. Similarly, efforts to manipulate the distribution of material in a club head with low and high density materials in various portions of the club head may impact the COR of the club head depending on how the material is distributed in the club head.

It would be advantageous to a provide materials for golf clubs that maximize the internal mass distribution and volume of the club head depending on the shape, size, and performance requirements of the particular club head. In addition, it would be beneficial to minimize the elasticity on the face to increase COR while still using a face material that has high strength since the face is a high stress area. Furthermore, there is a need in the art for materials that are capable of being joined to each other via conventional or unconventional methods. The present invention provides materials, golf club heads including the materials, and methods of making the golf club heads that includes the materials to achieve the proper balance between mass distribution and club head performance.

SUMMARY OF THE INVENTION

The present invention relates to a golf club head, including: a first zone including a body defining an inner volume, sole, and a skirt, wherein the first zone has a first density ranging from about 3 g/cm$^3$ to about 4 g/cm$^3$, and wherein the first zone is formed from a first laminate, wherein the first laminate includes a first layer and a second layer, and wherein the second layer faces the inner volume; a second zone including a crown, wherein the second zone is formed from a second laminate having a second density ranging from about 3 g/cm$^3$ to about 4 g/cm$^3$, wherein the second laminate is different from the first laminate; and a third zone including a face, wherein the third zone includes a third laminate including three layers.

In one embodiment, the second density is different from the first density. In another embodiment, the first layer has a density ranging from about 3 g/cm$^3$ to about 4 g/cm$^3$ and the second layer has a density ranging from about 2 g/cm$^3$ to about 3 g/cm$^3$. In still another embodiment, the first layer has a first thickness from about 0.1 mm to about 0.5 mm, and wherein the second layer has a second thickness ranging from about 0.4 to about 0.8. In yet another embodiment, the first layer has a first thickness, wherein the second layer has a second thickness, and wherein the ratio of the first thickness to second thickness ranges from about 1:1 to about 1:4.

The second laminate may include a third layer having a third density and a fourth layer having a fourth density, wherein the fourth density is less than the third density, and wherein the fourth layer faces the inner volume. In one embodiment, the third layer has a third thickness and the fourth layer has a fourth thickness, and wherein the fourth thickness is greater than the third thickness.

The golf club head may include one or more weights and one or more corresponding weight ports.

The present invention also relates to a golf club head that includes a body defining an inner volume, a sole, a skirt, a crown, and a face, wherein the sole includes a first zone, wherein the first zone has a first density ranging from about 5.5 g/cm$^3$ to about 7 g/cm$^3$, wherein the crown includes a second zone, wherein the second zone has a second density less than the first density and ranging from about 3 g/cm$^3$ to about 4.5 g/cm$^3$, and wherein the face includes a third zone.

In one embodiment, the first zone includes a first laminate including a first layer including titanium, titanium alloy, or a combination thereof and a second layer having a density ranging from about 6.0 g/cm$^3$ to about 8.0 g/cm$^3$. In an alternate embodiment, the first zone includes monolithic zirconium. The second layer may include steel, steel alloy, or a combination thereof. In this aspect of the invention, the third zone may include a laminate including a plurality of layers, and wherein the laminate has a density less than the first density. In another embodiment, the third zone includes monolithic titanium.

The second zone may include a second laminate including a third layer and a fourth layer, wherein the third layer has a third density and includes titanium, titanium alloy, or a combination thereof, and wherein the fourth layer has a fourth density less than the third density and includes aluminum, aluminum alloy, or combinations thereof.

The present invention is also directed to a golf club head that includes: a first zone including a body defining an inner volume, sole, and a skirt, wherein the first zone has a density ranging from about 3 g/cm$^3$ to about 4 g/cm$^3$, and wherein the first zone is formed from a first laminate, wherein the first laminate includes a first layer having a first density and a second layer having a second density less than the first density, and wherein the second layer faces the inner volume; a second zone including a crown; and a third zone including a face.

The first layer may have a density ranging from about 3 g/cm$^3$ to about 4 g/cm$^3$ and the second layer has a density ranging from about 2 g/cm$^3$ to about 3 g/cm$^3$. The first layer may also have a first thickness, wherein the second layer has a second thickness, and wherein the ratio of the first thickness to second thickness ranges from about 1:1 to about 1:4. In one embodiment, the first layer has a first thickness from about 0.1 mm to about 0.5 mm, and wherein the second layer has a second thickness ranging from about 0.4 to about 0.8.

BRIEF DESCRIPTION OF THE DRAWINGS

Further features and advantages of the invention can be ascertained from the following detailed description that is provided in connection with the drawings described below.

DETAILED DESCRIPTION OF THE PREFERRED EMBODIMENTS

Figure 1:
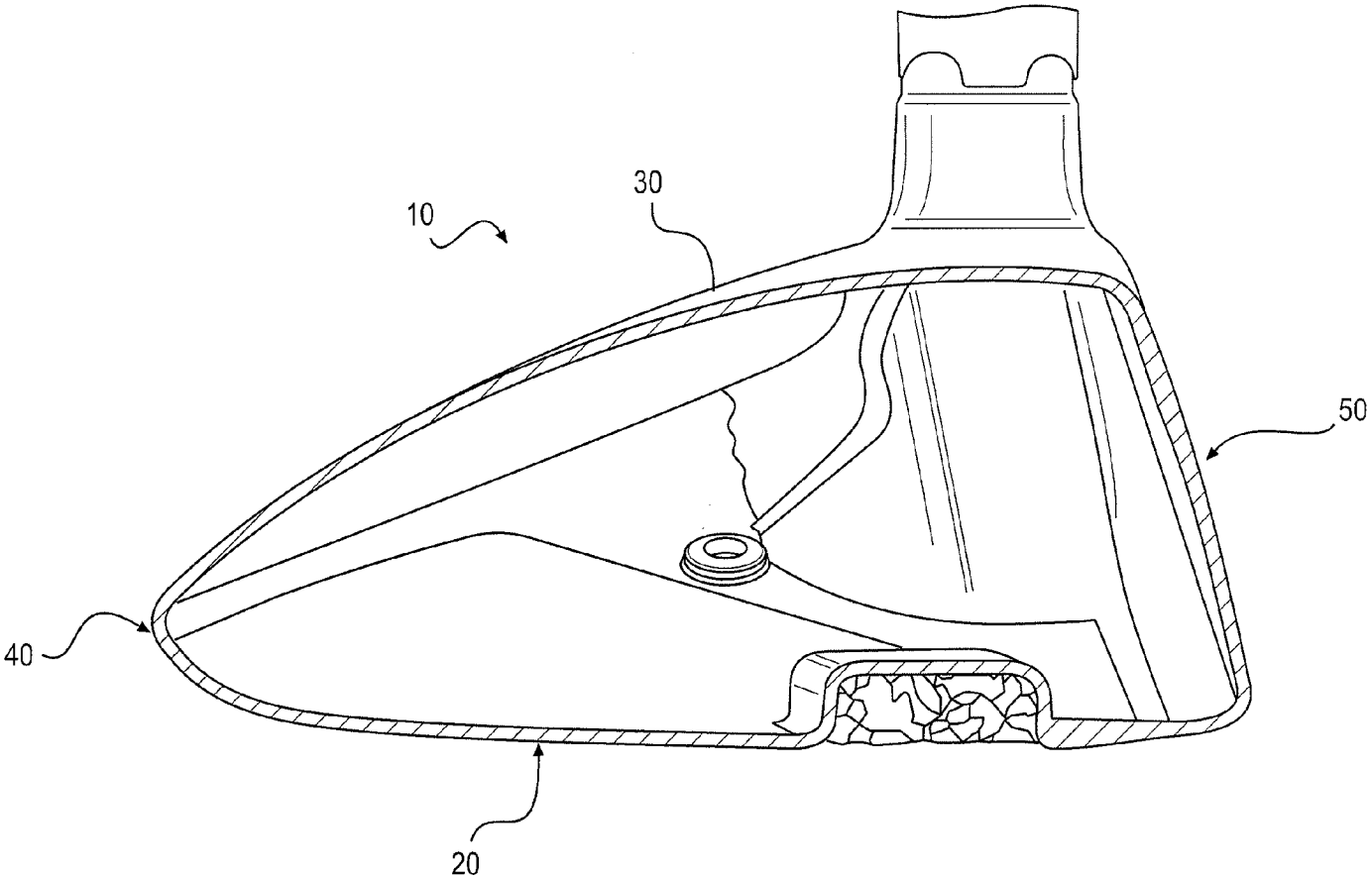
FIG. 1 shows a cross-section of one embodiment of a golf club head according to the present invention.

The present invention relates to wood-type golf club heads, golf clubs, and the like (such as drivers, fairway woods, hybrids, and/or the like), as well as to methods of making and using such clubs and club heads. The club head body member may take on a variety of different forms, shapes, and/or sizes without departing from this invention and includes, but is not limited to, a club head body member defining an interior chamber, a striking face, a crown portion, and a sole portion.

The club head may be made of a one piece construction or from a multi-piece construction. In a multi-piece construction, the club head body member is made from multiple components having one or more zones that are joined together via welding, brazing, adhesive bonding, or combinations thereof. In one embodiment, a club head body member includes a plurality of zones, each formed with materials or laminates having different densities that are joined together. The club head body member may include two zones, three zones, four zones, five zones, six zones, or more than six zones.

While the overall weight of the wood-type golf club head of the invention will vary depending on the specific type, i.e., driver, fairway wood, hybrid, the use of the materials described herein and the methods of forming the golf club heads of the invention provide a manufacturer the ability to maximize volume, increase COR, adjust MOI and COG by strategically distributing the mass in different zones of the club head, and improve overall durability of the club head. For example, even through a wood-type golf club head will always be designed to weigh between about 190 g and 205 g, the specific materials used in the golf club head allow the maximum volume, COR, and strength with adjustability in the MOI and COG for the particular type of wood-type golf club head.

High Density Zones

In certain areas of the club head, high density materials are optimal because they spread out mass over a wider area as opposed to a large mass at a localized point. For example, the sole of the golf club head, which suffers repeated impact with the ground, is a portion of the club head that requires durable materials and provides design opportunities to keep the COG as low or as close to the neutral axis as possible. The high density zones of a club head of the present invention preferably have equivalent densities ranging from about 5.5 g/cm$^3$ to about 8 g/cm$^3$. In another embodiment, a high density zone according to the present invention has an equivalent density ranging from about 5.75 g/cm$^3$ to about 7.9 g/cm$^3$. In yet another embodiment, the equivalent density ranges from about 6 g/cm$^3$ to about 7.8 g/cm$^3$. In still another embodiment, the high density zones have equivalent densities ranging from about 6 g/cm$^3$ to about 7 g/cm$^3$.

The thickness of the high density zones may vary depending on the placement of the zone in the club head. In one embodiment, the high density zone may have an average thickness that ranges from about 0.5 mm to about 2.5 mm. In another embodiment, the average thickness of the high density zone may range from about 0.75 mm to about 2.0 mm. In still another embodiment, the high density zones have thicknesses ranging from about 1.0 mm to about 1.8 mm.

The weight of the high density zone may be from about 30 g to about 50 g. In one embodiment, the mass of the high density zone ranges from about 30 g to about 40 g. In another embodiment, the mass of the high density zone ranges from about 34 g to about 38 g.

The high density zone or zones may comprise about 5 percent to about 40 percent of the club head. In one embodiment, the high density zone comprises about 10 percent to about 30 percent of the club head. In another embodiment, the high density zone comprises at least about 15 percent of the club head. In still another embodiment, about 15 percent to about 20 percent of the club head comprises one or more high density zones.

In one embodiment, the high density zone may be formed from a laminate that includes at least two layers. The high density zone may also be formed from more than two layers. For example, in one embodiment, the high density zone includes at least three layers. In another embodiment, the high density zone includes at least four layers. In an alternate embodiment, the high density zone is formed from a single layer.

For example, a high density zone according to the invention may be formed from a first layer having a first density and a first thickness and a second layer having a second density and a second thickness. In this aspect of the invention, the first density may range from about 6.0 g/cm$^3$ to about 8 g/cm$^3$. In another embodiment, the first density ranges from about 6.5 g/cm$^3$ to about 7.9 g/cm$^3$. In yet another embodiment, the first density ranges from about 6.75 g/cm$^3$ to about 7.8 g/cm$^3$. In still another embodiment, the first density ranges from about 7.0 g/cm$^3$ to about 7.8 g/cm$^3$. The second density may range from about 3.5 g/cm$^3$ to about 5.5 g/cm$^3$. In another embodiment, the second density ranges from about 4.0 g/cm$^3$ to about 5.0 g/cm$^3$. In yet another embodiment, the second density ranges from about 4.25 g/cm$^3$ to about 4.75 g/cm$^3$. In still another embodiment, the second density ranges from about 4.3 g/cm$^3$ to about 4.5 g/cm$^3$.

The ratio of the first thickness to the second thickness may be from about 0.5 to about 4. In one embodiment, the ratio of the first thickness to the second thickness is about 1 to about 3. In another embodiment, the ratio of the first thickness to the second thickness is about 1 to about 2. The first thickness may range from about 0.5 mm to about 1.0 mm. In one embodiment, the first thickness ranges from about 0.55 mm to about 0.95 mm. In another embodiment, the first thickness ranges from about 0.6 mm to about 0.9 mm. The second thickness may ranges from about 0.1 mm to about 0.8 mm. In one embodiment, the second thickness ranges from about 0.2 mm to about 0.7 mm. In another embodiment, the second thickness ranges from about 0.3 mm to about 0.65 mm.

The first and second layers may be made from any material having a density in the desired range. In one embodiment, the first layer is formed from steel, zirconium, copper, nickel, zinc, chromium, manganese, niobium, molybdenum, hafnium, tantalum, or combinations and alloys thereof. The second layer may be formed from titanium, titanium alloy, aluminum, aluminum alloy, or combinations thereof. For example, a high density zone according to the present invention may be formed from a first layer of stainless steel and a second layer of titanium or titanium alloy.

Suitable, but not limiting examples of titanium materials for use with the present invention include alpha or near-alpha titanium alloys such as Ti-8Al-1V-1Mo, Ti-5Al-1Fe-1Cr-0.7Mo, alpha-beta alloys such as Ti-6Al-4V (Ti-6-4), Ti-4.5Al-3V-2Fe-2Mo (SP-700), and Ti-5Al-1Sn-1Zr-1V-0.8Mo (Ti-5111), and heat treated beta alloys such as Ti-15-3-3-3, Beta C, DAT 51, DAT 55. Other suitable titanium alloys include alpha and near-alpha alloys such as Ti-0.3Mo-0.8Ni, Ti-3Al-2.5V, Ti-3Al-2.5V—Pd, Ti-3Al-2.5V—Ru, Ti-5Al-2.5Sn, Ti-5Al-2.5Sn ELI, Ti-8Al-1Mo-1V, and Ti-6Al-2Sn-4Zr-2Mo-0.1Si, alpha-beta alloys such as Ti-6Al-4V ELI, Ti-6Al-4V-0.1Ru, Ti-6Al-7Nb, Ti-6Al-6V-2Sn, Ti-6Al-2Sn-4Zr-6Mo, Ti-4Al-4Mo-2Sn-0.5Si, Ti-6Al-2Sn-2Zr-2Mo-2Cr-0.15Si, and Ti-5Al-4Cr-4Mo-2Sn-2Zr, Ti-4Al-2.5V-1.5Fe, Ti-4.5Al-2Mo-1.5V-0.5Fe, Ti-6Al-1.5V-1.5Mo-0.3Fe, Ti-5Al-4V-0.8Mo-0.5Fe, beta and near-beta alloys such as Ti-10V-2Fe-3Al, Ti-3Al-8V-6Cr-4Zr-4Mo, and Ti-3Al-8V-6Cr-4Zr-4Mo-0.05Pd, Ti-15Mo-5Zr-3Al, Ti-15Mo-3Al, Ti-20V-3.5Al-1Sn, and Ti-5Al-5Mo-5V-3Cr, and mixtures thereof.

In one embodiment, the high density zone may form at least a part of the sole of the golf club head. For example, as shown in FIG. 1 the sole wall 20 may be formed from a high density zone. In another embodiment, at least one other part of the club head is formed form a high density zone.

When the high density zones are laminate, the laminates may be formed using any conventional process available to those of ordinary skill in the art. For example, the laminate may be formed with the cladding or cold roll bonding process to the desired thickness by rolling together a sheet of a first material and a sheet of the second material under high pressure to form a metallurgical bond between the two materials.

The laminate sheet may then be used to obtain the required shapes via stamping, water jet cutting, or laser cutting. Once the shapes for the high density zones are obtained, they may be warm or hot formed to fabricate the components, which will ultimately be joined together with other components to form the club head via welding, brazing, adhesive bonding, ultrasonic energy, or combinations thereof.

Because the melting point of the material used to form the second layer may be less than the melting point of the material used to form the first layer, welding the components together to form the club head may lead to meltdown of the material used to form the second layer. Accordingly, the second layer having a lower melting point may be machined off along the perimeter of the shape prior to component fabrication. Alternatively, other forms of welding that generate less heat, i.e., laser welding or plasma welding, may avoid material meltdown in the second laminate layer.

The club head is preferably formed such that the less dense layer of the laminate forms the outer layer of the club head and the denser layer forms the inner surface. For example, in one embodiment, the laminate is formed from titanium and steel and the steel forms the inner surface of the high density zone.

Low Density Zones

Similar to the need for high density zones, golf club heads also may include low density zones with mass savings spread out over a broad area. For example, the crown of the golf club head suffers minimal impact with the ground or ball and, thus, is an area of the club head that may be formed from low density materials in an effort to manipulate the overall weight of the club head and the center of gravity of the club head.

The low density zones of a club head of the present invention preferably have equivalent densities ranging from about 2.5 g/cm$^3$ to about 4.5 g/cm$^3$. In another embodiment, a low density zone according to the present invention has an equivalent density ranging from about 2.75 g/cm$^3$ to about 4.0 g/cm$^3$. In yet another embodiment, the equivalent density ranges from about 3 g/cm$^3$ to about 3.75 g/cm$^3$. In still another embodiment, the low density zones have equivalent densities ranging from about 3 g/cm$^3$ to about 3.70 g/cm$^3$.

The thickness of the low density zones may vary depending on the placement of the zone in the club head. In one embodiment, the low density zone may have an average thickness that ranges from about 0.1 mm to about 1.0 mm. In another embodiment, the average thickness of the low density zone may range from about 0.2 mm to about 0.8 mm. In still another embodiment, the low density zones have thicknesses ranging from about 0.3 mm to about 0.75 mm.

The weight of the low density zone may be from about 10 g to about 30 g. In one embodiment, the mass of the low density zone ranges from about 15 g to about 25 g. In another embodiment, the low density zone ranges in weight from about 18 g to about 22 g. In this aspect of the invention, the low density zone preferably has a weight range that is about 80 percent to about 98 percent of the weight range of a Ti-6-4 crown having the same dimensions. In one embodiment, the low density zone weight range is about 83 to about 97 percent of the weight range of a Ti-6-4 crown having the same dimensions.

The low density zone or zones may comprise about 20 percent to about 50 percent of the club head. In one embodiment, the low density zone comprises about 25 percent to about 45 percent of the club head. In another embodiment, the low density zone comprises at least about 30 percent of the club head. In still another embodiment, about 32 percent to about 40 percent of the club head comprises one or more low density zones.

In one embodiment, the low density zone may be formed from a laminate that includes at least two layers. The low density zone may also be formed from more than two layers.

For example, in one embodiment, the low density zone includes at least three layers. In another embodiment, the low density zone includes at least four layers. In an alternate embodiment, the low density zone is formed from a single layer.

For example, a low density zone according to the invention may be formed from a first layer having a first density and a first thickness and a second layer having a second density and a second thickness. In this aspect of the invention, the first density may range from about 3.5 g/cm$^3$ to about 5.5 g/cm$^3$. In another embodiment, the first density ranges from about 4.0 g/cm$^3$ to about 5.0 g/cm$^3$. In yet another embodiment, the first density ranges from about 4.25 g/cm$^3$ to about 4.75 g/cm$^3$. In still another embodiment, the first density ranges from about 4.3 g/cm$^3$ to about 4.6 g/cm$^3$. The second density may range from about 1.5 g/cm$^3$ to about 4.0 g/cm$^3$. In another embodiment, the second density ranges from about 2.0 g/cm$^3$ to about 3.5 g/cm$^3$. In yet another embodiment, the second density ranges from about 2.2 g/cm$^3$ to about 3.0 g/cm$^3$. In still another embodiment, the second density ranges from about 2.3 g/cm$^3$ to about 2.8 g/cm$^3$.

The ratio of the first thickness to the second thickness may be from about 6:1. In one embodiment, the ratio of the first thickness to the second thickness is about 1:5. In another embodiment, the ratio of the first thickness to the second thickness is about 1:4. In still another embodiment, the ratio of the first thickness to the second thickness is about 1:3. For example, the first thickness to second thickness ratio may be from about 1:2. In another embodiment, the low density zone has a first thickness to second thickness ratio from about 1:1. The first thickness may range from about 0.05 mm to about 0.5 mm. In one embodiment, the first thickness ranges from about 0.1 mm to about 0.6 mm. In another embodiment, the first thickness ranges from about 0.2 mm to about 0.3 mm. The second thickness may range from about 0.2 mm to about 1.0 mm. In one embodiment, the second thickness ranges from about 0.25 mm to about 0.7 mm. In another embodiment, the second thickness ranges from about 0.30 mm to about 0.6 mm.

In one embodiment, the low density zone may form at least a part of the crown of the golf club head. For example, as shown in FIG. 1 the crown 30 may be formed from a low density zone.

In another embodiment, at least one other part of the club head is formed form a second low density zone. For example, as shown in FIG. 1, the second low density zone may form the skirt 40 and, optionally, at least a portion of the sole 20 of the club head. In this aspect of the invention, the second low density zone may have an equivalent density ranging from about 2.5 g/cm$^3$ to about 4.5 g/cm$^3$. In another embodiment, the second low density zone according to the present invention has an equivalent density ranging from about 2.75 g/cm$^3$ to about 4.0 g/cm$^3$. In yet another embodiment, the equivalent density of the second low density zone ranges from about 3 g/cm$^3$ to about 3.9 g/cm$^3$. In still another embodiment, the second low density zone has an equivalent density ranging from about 3.1 g/cm$^3$ to about 3.8 g/cm$^3$.

The thickness of the second low density zone may vary depending on the placement of the zone in the club head. In one embodiment, the second low density zone may have an average thickness that ranges from about 0.3 mm to about 1.5 mm. In another embodiment, the average thickness of the low density zone may range from about 0.4 mm to about 1.3 mm. In still another embodiment, the low density zones have thicknesses ranging from about 0.5 mm to about 1.0 mm.

The weight of the second low density zone may be from about 30 g to about 60 g. In one embodiment, the second low density zone ranges in weight from about 35 g to about 50 g. In another embodiment, the second low density zone ranges from about 38 g to about 48 g. In this aspect of the invention, the second low density zone preferably has a weight range that is about 80 percent to about 98 percent of the weight range of a Ti-6-4 skirt/sole having the same dimensions. In one embodiment, the second low density zone weight range is about 83 to about 97 percent of the weight range of a Ti-6-4 skirt/sole having the same dimensions.

The second low density zone or zones may comprise about 40 percent to about 60 percent of the club head. In one embodiment, the second low density zone comprises about 45 percent to about 55 percent of the club head. In another embodiment, the second low density zone comprises at least about 45 percent of the club head. In still another embodiment, about 45 percent to about 53 percent of the club head comprises one or more second low density zones.

In one embodiment, the second low density zone may be formed from a laminate that includes at least two layers. The second low density zone may also be formed from more than two layers. For example, in one embodiment, the second low density zone includes at least three layers. In another embodiment, the second low density zone includes at least four layers. In an alternate embodiment, the second low density zone is formed from a single layer.

For example, a second low density zone according to the invention may be formed from a first layer having a first density and a first thickness and a second layer having a second density and a second thickness. In this aspect of the invention, the first density may range from about 3.5 g/cm$^3$ to about 5.5 g/cm$^3$. In another embodiment, the first density ranges from about 4.0 g/cm$^3$ to about 5.0 g/cm$^3$. In yet another embodiment, the first density ranges from about 4.25 g/cm$^3$ to about 4.75 g/cm$^3$. In still another embodiment, the first density ranges from about 4.3 g/cm$^3$ to about 4.6 g/cm$^3$. The second density may range from about 1.5 g/cm$^3$ to about 4.0 g/cm$^3$. In another embodiment, the second density ranges from about 2.0 g/cm$^3$ to about 3.5 g/cm$^3$. In yet another embodiment second the first density ranges from about 2.2 g/cm$^3$ to about 3.0 g/cm$^3$. In still another embodiment, the second density ranges from about 2.3 g/cm$^3$ to about 2.8 g/cm$^3$.

The ratio of the first thickness to the second thickness may be from about 1:6. In one embodiment, the ratio of the first thickness to the second thickness is about 1:5. In another embodiment, the ratio of the first thickness to the second thickness is about 1:4. In still another embodiment, the ratio of the first thickness to the second thickness is about 1:3. For example, the first thickness to second thickness ratio may be from about 1:2. In another embodiment, the low density zone has a first thickness to second thickness ratio from about 1:1. The first thickness may range from about 0.1 mm to about 0.6 mm. In one embodiment, the first thickness ranges from about 0.15 mm to about 0.5 mm. In another embodiment, the first thickness ranges from about 0.16 mm to about 0.48 mm. The second thickness may range from about 0.3 mm to about 1.0 mm. In one embodiment, the second thickness ranges from about 0.35 mm to about 0.9 mm. In another embodiment, the second thickness ranges from about 0.40 mm to about 0.8 mm.

The first and second layers in the low density zones may be made from any material having a density in the desired range. In one embodiment, the second layer is formed from aluminum, aluminum alloy, or combinations thereof. The first layer may be formed from titanium, titanium alloy, or combinations thereof. For example, a second low density zone according to the present invention may be formed from a first layer of titanium or titanium alloy and a second layer of aluminum or aluminum alloy.

Suitable, but not limiting examples of titanium materials for use with the low density zones of the present invention include alpha or near-alpha titanium alloys such as Ti-8Al-1V-1Mo, Ti-5Al-1Fe-1Cr-0.7Mo, alpha-beta alloys such as Ti-6Al-4V (Ti-6-4), Ti-4.5Al-3V-2Fe-2Mo (SP-700), and Ti-5Al-1Sn-1Zr-1V-0.8Mo (Ti-5111), and heat treated beta alloys such as Ti-15-3-3-3, Beta C, DAT 51, DAT 55. Other suitable titanium alloys include alpha and near-alpha alloys such as Ti-0.3Mo-0.8Ni, Ti-3Al-2.5V, Ti-3Al-2.5V—Pd, Ti-3Al-2.5V—Ru, Ti-5Al-2.5Sn, Ti-5Al-2.5Sn ELI, Ti-8Al-1Mo-1V, and Ti-6Al-2Sn-4Zr-2Mo-0.1Si, alpha-beta alloys such as Ti-6Al-4V ELI, Ti-6Al-4V-0.1Ru, Ti-6Al-7Nb, Ti-6Al-6V-2Sn, Ti-6Al-2Sn-4Zr-6Mo, Ti-4Al-4Mo-2Sn-0.5Si, Ti-6Al-2Sn-2Zr-2Mo-2Cr-0.15Si, and Ti-5Al-4Cr-4Mo-2Sn-2Zr, beta and near-beta alloys such as Ti-10V-2Fe-3Al, Ti-3Al-8V-6Cr-4Zr-4Mo, and Ti-3Al-8V-6Cr-4Zr-4Mo-0.05Pd, Ti-15Mo-5Zr-3Al, Ti-15Mo-3Al, Ti-20V-3.5Al-1Sn, and Ti-5Al-5Mo-5V-3Cr, and mixtures thereof.

Suitable, but not limiting examples of aluminum materials for use with the low density zone include 1000 series, 2000 series, 3000 series, 4000 series, 5000 series, 6000 series, 7000 series and 8000 series aluminum alloys, examples of which are Al 2014, Al 2024, Al 3003, Al 5052, Al 5083, Al 6061, Al 6063, Al 7005, Al 7075, Al 8091, and combinations thereof.

When the low density zones are laminate, the laminates may be formed using any conventional process available to those of ordinary skill in the art. For example, the laminate may be formed with the cladding or cold roll bonding process to the desired thickness. In one embodiment, forming the laminate includes rolling together a sheet of a first material and a sheet of the second material under high pressure to form a metallurgical bond between the two materials.

The laminate sheet may then be used to obtain the required shapes via stamping, water jet cutting, or laser cutting. Once the shapes for the low density zones are obtained, they may be warm or hot formed to fabricate the components, which will ultimately be joined together with other components to form the club head via welding, brazing, adhesive bonding, ultrasonic energy, or combinations thereof.

Because the melting point of the material used to form the second layer may be less than the melting point of the material used to form the first layer, welding the components together to form the club head may lead to meltdown of the material used to form the second layer. Accordingly, the second layer having the lower melting point may be machined off along the perimeter of the shape prior to component fabrication. Alternatively, other forms of welding that generate less heat, i.e., laser welding or plasma welding, may avoid material meltdown in the second laminate layer.

The club head is preferably formed such that the denser laminate layer of the low density zone forms the outer surface of the club head and the less dense layer forms the inner surface. For example, in one embodiment, the laminate is formed from titanium and aluminum and the aluminum forms the inner surface of the high density zone.

Reinforced Low Density Zones

Figure 2A:
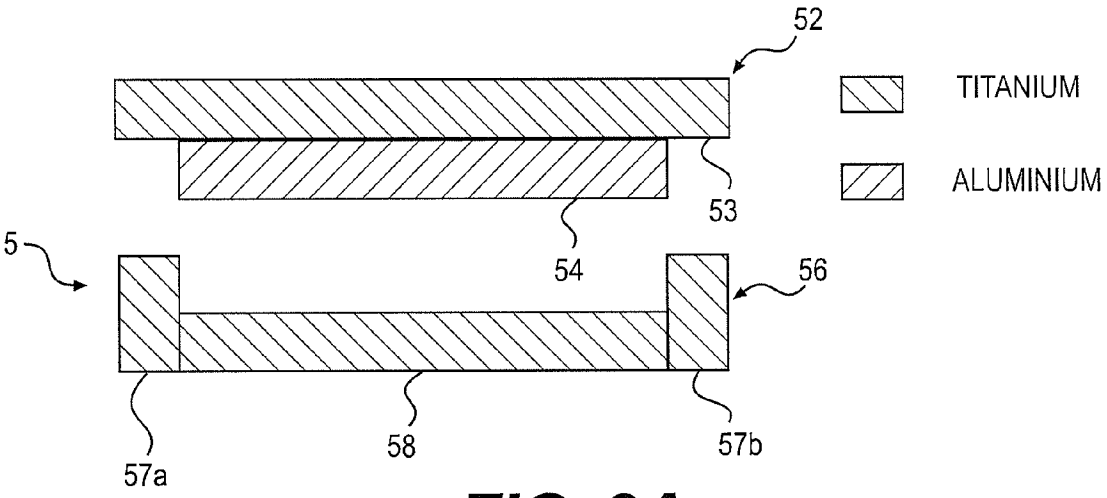
FIGS. 2A and 2B shows a side of a component of a golf club head according to one embodiment of the present invention.

Certain areas of the club head may be formed from a reinforced low density zone. For example, in one embodiment, a reinforced low density zone may be formed form a laminate that includes a low density laminate and a reinforcing layer. As shown in FIG. 2A, the reinforced low density zone 51 may include a low density laminate 52 as discussed above with respect to the low density zones with a reinforcing layer 56. In particular, the low density laminate may have an equivalent density ranging from about 2.5 g/cm$^3$ to about 4.5 g/cm$^3$. In another embodiment, a low density laminate according to the present invention has an equivalent density ranging from about 2.75 g/cm$^3$ to about 4.0 g/cm$^3$. In yet another embodiment, the equivalent density of the low density laminate ranges from about 3 g/cm$^3$ to about 3.75 g/cm$^3$. In still another embodiment, the low density laminate has an equivalent density ranging from about 3 g/cm$^3$ to about 3.70 g/cm$^3$.

The low density laminate may be formed from a first layer 53 having a first density and a second layer 54 having a second density. In one embodiment, the first density is greater than the second density. For example, the first density may range from about 3.5 g/cm$^3$ to about 5.5 g/cm$^3$ and the second density may range from about 1.5 g/cm$^3$ to about 4.0 g/cm$^3$. In another embodiment, the first density ranges from about 4.0 g/cm$^3$ to about 5.0 g/cm$^3$ and the second density ranges from about 2.0 g/cm$^3$ to about 3.5 g/cm$^3$. In yet another embodiment, the first density ranges from about 4.25 g/cm$^3$ to about 4.75 g/cm$^3$ and the second density ranges from about 2.2 g/cm$^3$ to about 3.0 g/cm$^3$. In still another embodiment, the first density ranges from about 4.3 g/cm$^3$ to about 4.6 g/cm$^3$ and the second density ranges from about 2.3 g/cm$^3$ to about 2.8 g/cm$^3$. The material used to form the first layer may be any of the titanium materials discussed above with respect to the low density zone. Likewise, in one embodiment, the material used to form the second layer of the low density laminate may be any of the aluminum materials discussed above with respect to the low density zone.

The reinforcing layer 56 may be formed of a material having a density of about 4 g/cm$^3$ to about 5 g/cm$^3$. In one embodiment, the reinforcing layer 56 is formed from a material having a density of about 4.2 g/cm$^3$ to about 4.8 g/cm$^3$. In another embodiment, the material used to form the reinforcing layer has a density of about 4.4 g/cm$^3$ to about 4.6 g/cm$^3$. The material used to form the reinforcing layer may be titanium or titanium alloy.

The reinforced low density zone may be fabricated using a number of methods. For example, the laminate may be formed with the cladding or cold roll bonding process to the desired thickness by rolling together a sheet of a first material and a sheet of the second material under high pressure to form a metallurgical bond between the two materials. The resulting laminate sheet may then be used to obtain the required shapes via stamping, water jet cutting, or laser cutting. Once the shapes for the low density zones are obtained, the second layer may be machined to facilitate welding of the reinforcing layer. In particular, as shown in FIG. 2A, the second layer 54 may be machined off along the perimeter of the laminate to create a step. The reinforcing layer 56 may be stamped and machined to form a cavity to accommodate the second layer 54. In the alternative, the reinforcing layer 56 may include multiple components such as side walls 57*a* and 57*b* and base 58 that are joined together. In one embodiment, the side walls and base are formed of the same material. In another embodiment, the side walls and base are formed of different materials.

Figure 2B:
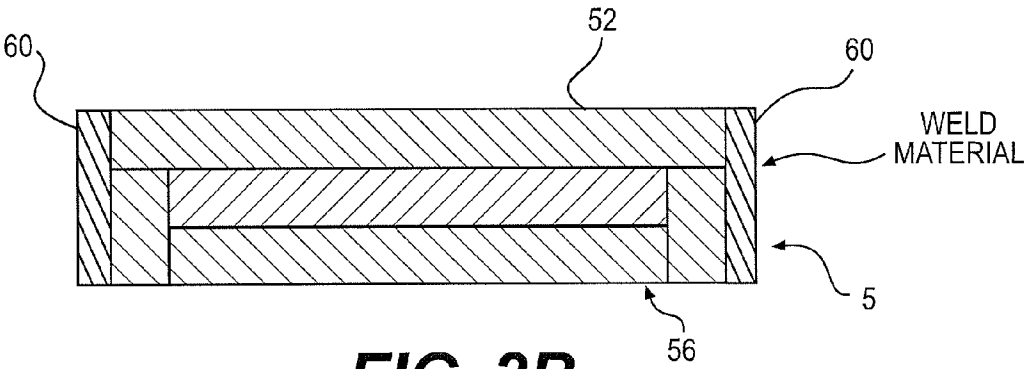

As further shown in FIG. 2B, the low density laminate 52 and reinforcing layer 56 may be welded together (for example with weld material 60 along the perimeter) and machined to remove excess material. The welding may be conventional welding, laser welding, plasma welding, or variations thereof. The low density laminate 52 and reinforcing layer 56 may also be joined together via brazing, adhesive bonding, ultrasonic energy, or combinations thereof.

After the reinforced low density zone is obtained, it may be formed to provide a bulge and roll if used as a face insert and welded to the face insert cavity. Alternatively, the low density laminate 52 and reinforcing layer 56 may be welded into the face cavity simultaneously.

Club Heads Formed from Low and High Density Zones

The club heads of the invention may include at least one high density zone, at least one low density zone, at least one reinforced low density zone, and combinations thereof. In one embodiment, the club head includes a high density zone that forms at least a portion of the sole. In another embodiment, the club head includes a low density zone that forms at least a portion of the crown. In yet another embodiment, a second low density zone forms at least a portion of the club head body, skirt, and sole.

In this aspect of the invention, the face may be formed from monolithic titanium. In another embodiment, the face and the area surrounding the face (leading crown and leading sole areas), may be formed from monolithic titanium. In still another embodiment, the club head may include a reinforced low density zone that forms at least a portion of the face.

Figure 3:
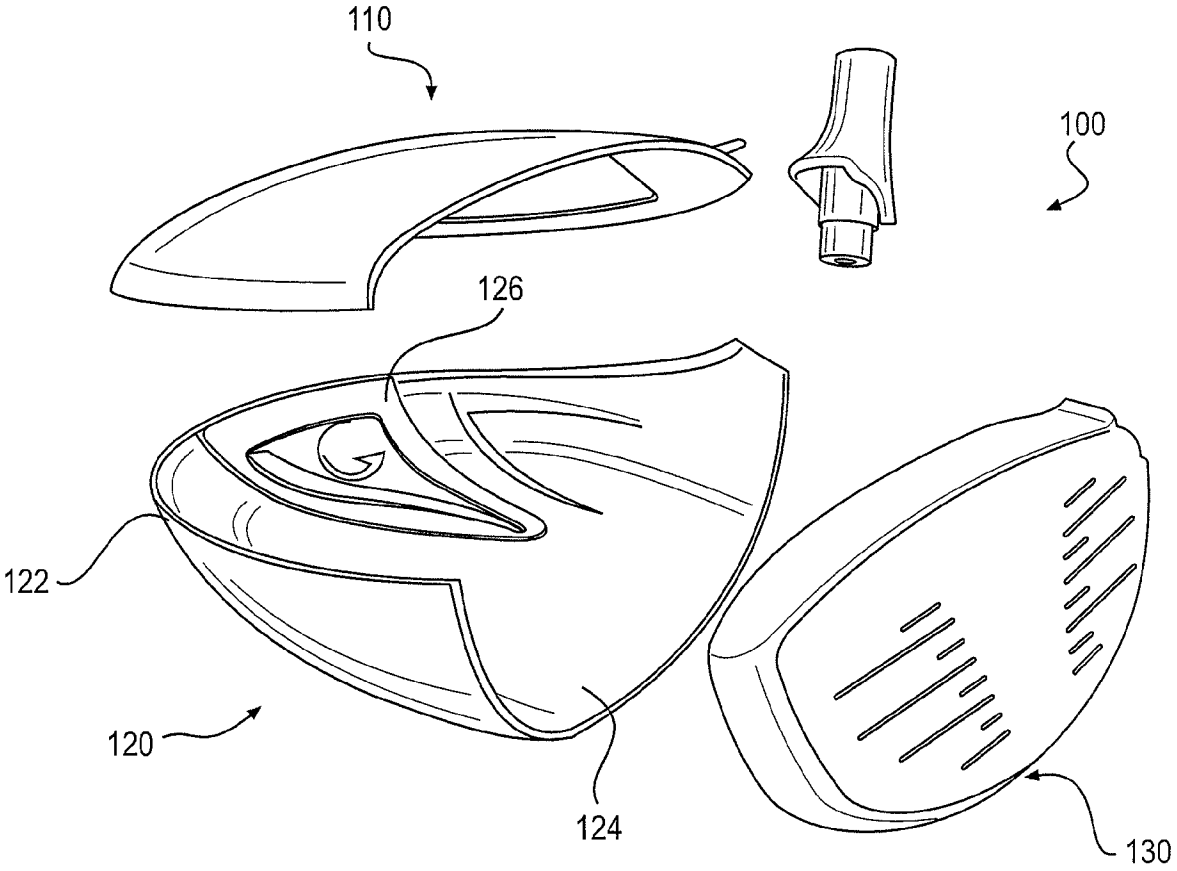
FIG. 3 shows an exploded view of a golf club head according to the present invention.

FIG. 3 shows a portion of a golf club head 100 according to one embodiment of the present invention. In the illustrated embodiment, the club head body member 110 may be formed from a first low density titanium alloy. The crown 110 is formed form a first low density zone. The face insert 130 is formed from a reinforced low density zone. The club head body 120, which includes the skirt and sole for the purposes of this embodiment, may be formed from a second low density zone.

In another embodiment, at least a portion of the club head body 120, is formed from a the second low density zone and at least a second portion of the club head body 120, which includes the sole 124 may be formed from a high density zone. In particular, the skirt 122 may be formed of a second low density zone and the sole 124 may be formed of a high density zone.

In such embodiments, the components may be coupled to each other in a variety of manners with ultrasonic energy being one preferred manner. In FIG. 1, the hosel is shown, but is not considered to be part of the club head body member. At least one weight port 126 may be used in the club head body. Furthermore, while wood-type club heads are illustrated, the inventive embodiments described herein are not intended to be limited to such club heads. For example, iron-type club heads may also be designed with high and low density zones. In particular, in one embodiment, a high density zone may be incorporated into at least a portion of the sole of an iron-type club head by using ultrasonic welding.

The high and low density zones may be joined together with the club head body member (in the respective cavities) via welding, infrared brazing, adhesive bonding, ultrasonic energy, or combinations thereof. The zones may be joined together using the same or different methods. As would be appreciated by those of ordinary skill in the art, the type of welding used to join the components together may be any suitable welding that results in a joined product with the least weld material at the joints and heat affected zones. In this aspect, suitable types of welding for use with the present invention include, but are not limited to, laser welding, plasma welding, TIG welding, MIG welding, or combinations thereof. In one embodiment, the type of welding used to join either or both of the crown and face components may be laser welding, plasma welding, or combinations thereof. Without being bound to any specific theory, laser and plasma welding reduces the amount of material added at the joint and result in smaller heat affected zones (as compared to TIG welding).

In another embodiment, at least two zones are joined with ultrasonic energy. In particular, the use of ultrasonic energy may be used to fabricate a club head with precise joints for maximum performance. In addition, because ultrasonic processes do not use or generate more than a minimum amount of heat, the steps discussed above with respect to machining the second layer to avoid meltdown may be avoided when using ultrasonic energy. Finally, because ultrasonic energy does not result in oxidation or color change, club heads and the components therein that are bonded with ultrasonic energy will require less finishing (e.g., grinding and polishing).

The golf club constructions described above may be employed in a wood-type golf club. For a metal wood such as a driver or a fairway wood, the club head has a volume of about 90 cc to about 460 cc. Preferably, the volume of a metal wood club head is at least about 250 cc. According to one aspect of the invention, the volume for a hybrid club is between about 100 cc and about 200 cc. In one embodiment, the volume for a hybrid club is between about 125 cc and 150 cc. In one embodiment, the volume of a hybrid club according to the present invention may be less than 130 cc.

Finishing touches, e.g., painting and sanding, may optionally be performed for aesthetic purposes.

EXAMPLES

The following examples are provided to illustrate the present invention, and should not be construed as limiting thereof.

Example 1

A High Density Zone

A high density zone may be formed with the zone material and properties set forth in Table 1 below.

TABLE 1

HIGH DENSITY ZONE

| Zone Material | Laminate Density ($g/cm^2$) | Area ($cm^2$) | Sole Weight (g) | Thickness Ratio | Equivalent Sole Density ($g/cm^2$) | Average Total Sole Thickness (mm) | Laminate Thickness (cm) |
|---|---|---|---|---|---|---|---|
| steel | 7.80 | 46.00 | 35.88 | n/a | 7.80 | 1.00 | 0.10 |
| Ti 6-4 | 4.43 | 46.00 | 35.88 | n/a | 4.43 | 1.80 | 0.18 |
| zirconium | 6.40 | 46.00 | 35.88 | n/a | 6.40 | 1.20 | 0.12 |
| steel/Ti | 7.8/4.43 | 46.00 | 35.88 | 1 | 6.09 | 1.24 | .064/.064 |
| steel/Ti | 7.8/4.43 | 46.00 | 35.88 | 2 | 6.67 | 1.17 | .078/.039 |
| steel/Ti | 7.8/4.43 | 46.00 | 35.88 | 3 | 6.96 | 1.12 | .084/.028 |

When used in a sole of the club head with the area and thickness dimensions as set forth above, the steel/titanium laminate provides comparable center of gravity and moment of inertia values as the monolithic zirconium and steel materials.

Example 2

Low Density Zone

A low density zone may be formed as set forth in Table 2 below.

TABLE 2

LOW DENSITY ZONE

| Zone Material | Laminate Density ($g/cm^3$) | Area ($cm^2$) | Weight (g) | Thickness Ratio | Average Total Thickness (mm) | Laminate Thickness (mm) |
|---|---|---|---|---|---|---|
| Ti-6-4 | n/a | 103.1 | 22.83 | n/a | 0.5 | n/a |
| Laminate 1 | 3.07 | 103.1 | 19.00 | 1:5 | 0.6 | 0.1/0.5 |
| Laminate 2 | 3.21 | 103.1 | 19.84 | 1:3 | 0.6 | 0.15/0.45 |
| Laminate 3 | 3.34 | 103.1 | 20.68 | 1:2 | 0.6 | 0.2/0.4 |
| Laminate 4 | 3.62 | 103.1 | 22.36 | 1:1 | 0.6 | 0.3/0.3 |

If the zone materials of Table 2 are used in a crown, the weight savings using the laminates of the invention range from about 2 percent to about 17 percent as compared to a crown formed from Ti-6-4 (Table 3).

TABLE 3

LOW DENSITY ZONE WEIGHT SAVINGS

| Zone Material | Weight Savings (%) |
|---|---|
| Laminate 1 | 16.8 |
| Laminate 2 | 13.1 |
| Laminate 3 | 9.4 |
| Laminate 4 | 2.1 |

Example 3

Low Density Zone

A low density zone may be formed as set forth in Table 4 below.

TABLE 4

LOW DENSITY ZONE

| Zone Material | Laminate Density ($g/cm^3$) | Area ($cm^2$) | Weight (g) | Thickness Ratio | Average Total Thickness (mm) | Laminate Thickness (mm) |
|---|---|---|---|---|---|---|
| Ti-6-4 | n/a | 139.6 | 46.38 | n/a | 0.75 | n/a |
| Laminate 5 | 3.13 | 139.6 | 39.28 | 1:4 | 0.9 | 0.18/0.72 |
| Laminate 6 | 3.21 | 139.6 | 40.30 | 1:3 | 0.9 | 0.225/0.675 |
| Laminate 7 | 3.34 | 139.6 | 42.01 | 1:2 | 0.9 | 0.3/0.6 |
| Laminate 8 | 3.62 | 139.6 | 45.42 | 1:1 | 0.9 | 0.45/0.45 |

If the zone materials of Table 2 are used in the body, sole, and skirt with an overall area as provided in Table 4, the weight savings using the laminates of the invention range from about 2 percent to about 16 percent as compared to a crown formed from Ti-6-4 (Table 5).

TABLE 5

LOW DENSITY ZONE WEIGHT SAVINGS

| Zone Material | Weight Savings (%) |
|---|---|
| Laminate 1 | 15.3 |
| Laminate 2 | 13.1 |
| Laminate 3 | 9.4 |
| Laminate 4 | 2.1 |

Although the present invention has been described with reference to particular embodiments, it will be understood to those skilled in the art that the invention is capable of a variety of alternative embodiments within the spirit of the appended claims. For example, golf club heads in accordance with examples of this invention may include still additional features, if desired, including features that are known and used in the art. For example, a golf club head according to the invention may include a weighting system that is permanently mounted to the club head body member, e.g., on an interior or exterior of the club head body, extending from the exterior to the interior of the club head body (e.g., through a weight port), etc., or, in the alternative, a weighting system that includes weight member(s) that are movably and/or removably mounted with respect to the club head body member using structures and techniques that are known and used in the art (e.g., by screw or other mechanical connector attachments, by sliding attachments, etc.). Alternately, the sole may include one or more cavities that are capable of accommodating inserts having variable weights. In addition, golf clubs according to the invention may include one or more of: (a) a shaft member engaged with the club head body; (b) a grip member engaged with the shaft, and/or (c) a handle member engaged with the club head and/or the shaft. These additional elements of the golf club structure may be included in the overall club structure in any desired manner without departing from this invention, including in conventional manners that are known and used in the art (e.g., the shaft may be engaged with the club head body member via an external hosel member, via an internal hosel member, through an opening provided in the club head, via adhesives, and/or via mechanical connectors.

The invention claimed is:

1. A golf club head, comprising a body defining an inner volume, a sole, a skirt, a crown, and a face, wherein the sole comprises a first zone, wherein the first zone has a density ranging from about 5.5 $g/cm^3$ to about 7 $g/cm^3$, and wherein the first zone comprises a first laminate comprising a first layer and a second layer joined by a cladding bond, wherein the crown comprises a second zone, wherein the second zone has a density less than the density of the first zone and ranging from about 3 $g/cm^3$ to about 4.5 $g/cm^3$, and wherein the second zone comprises a second laminate comprising a first layer and a second layer joined by a cladding bond, and wherein the face comprises a third zone.

2. The golf club head of claim 1, wherein the first layer of the first laminate comprises titanium, titanium alloy, or a combination thereof and the second layer of the first laminate has a density ranging from about 6.0 $g/cm^3$ to about 8.0 $g/cm^3$.

3. The golf club head of claim 2, wherein the second layer of the first laminate comprises steel, steel alloy, or a combination thereof.

4. The golf club head of claim 2, wherein the third zone comprises a third laminate comprising a plurality of layers, and wherein the third laminate has a density less than the density of the first laminate.

5. The golf club head of claim 1, wherein the first layer of the second laminate comprises titanium, titanium alloy, or a combination thereof, and the second layer of the second laminate has a density less than the density of the first layer of the second laminate and comprises aluminum, aluminum alloy, or combinations thereof.

6. The golf club head of claim 1, wherein the density of the first zone, ranging from about 5.5 g/cm$^3$ to about 7 g/cm$^3$, is an equivalent density of the first zone as a whole.

7. The golf club head of claim 1, wherein the density of the second zone, ranging from about 3 g/cm$^3$ to about 4.5 g/cm$^3$, is an equivalent density of the second zone as a whole.

8. A golf club head, comprising a body defining an inner volume, a sole, a skirt, a crown, and a face, wherein the sole comprises a first laminate, wherein the first laminate has a density ranging from about 5.5 g/cm$^3$ to about 7 g/cm$^3$, wherein the crown comprises a second laminate, wherein the second laminate has a density less than the density of the first laminate and ranging from about 2.5 g/cm$^3$ to about 4.5 g/cm$^3$, and wherein the second laminate comprises a first layer and a second layer joined by a cladding bond.

9. The golf club head of claim 8, wherein the first laminate comprises a first layer comprising titanium, titanium alloy, or a combination thereof and a second layer having a density ranging from about 6.0 g/cm$^3$ to about 8.0 g/cm$^3$.

10. The golf club head of claim 9, wherein the second layer of the first laminate comprises steel, steel alloy, or a combination thereof.

11. The golf club head of claim 9, wherein the face comprises a third laminate comprising a plurality of layers, and wherein the third laminate has a density less than the density of the first laminate.

12. The golf club head of claim 8, wherein the first layer of the second laminate comprises titanium, titanium alloy, or a combination thereof, and wherein the second layer of the second laminate has a density less than the density of the first layer of the second laminate and comprises aluminum, aluminum alloy, or combinations thereof.

13. The golf club head of claim 8, wherein the density of the first laminate is an equivalent density of the first laminate as a whole and ranges from about 5.5 g/cm$^3$ to about 7 g/cm$^3$.

14. The golf club head of claim 8, wherein the density of the second laminate is an equivalent density of the second laminate as a whole and ranges from about 2.5 g/cm$^3$ to about 4.5 g/cm$^3$.

15. A golf club head, comprising a body defining an inner volume, a sole, a skirt, a crown, and a face, wherein the sole comprises a first zone, wherein the crown comprises a second zone, wherein the face comprises a third zone, wherein the first zone has a density ranging from about 5.5 g/cm$^3$ to about 7 g/cm$^3$ and comprises a first laminate comprising a first layer and a second layer joined by a cladding bond, and wherein the first layer of the first laminate comprises titanium, titanium alloy, or a combination thereof and the second layer of the first laminate comprises steel, steel alloy, or a combination thereof, and wherein the second zone has a density less than the density of the first zone and ranges from about 2.5 g/cm$^3$ to about 4.5 g/cm$^3$ and comprises a second laminate comprising a first layer and a second layer joined by a cladding bond, and wherein the first layer of the second laminate comprises titanium, titanium alloy, or a combination thereof and the second layer of the second laminate comprises aluminum, aluminum alloy, or combinations thereof.

16. The golf club head of claim 15, wherein the third zone comprises a third laminate comprising a plurality of layers, and wherein the third zone has a density less than the density of the first zone.

17. The golf club head of claim 15, wherein the density of the first zone is an equivalent density of the first zone as a whole and ranges from about 5.5 g/cm$^3$ to about 7 g/cm$^3$.

18. The golf club head of claim 15, wherein the density of the second zone is an equivalent density of the second zone as a whole and ranges from about 2.5 g/cm$^3$ to about 4.5 g/cm$^3$.

* * * * *